United States Patent [19]

Pryor

[11] 4,353,408

[45] Oct. 12, 1982

[54] ELECTROMAGNETIC THIN STRIP CASTING APPARATUS

[75] Inventor: Michael J. Pryor, Woodbridge, Conn.

[73] Assignee: Olin Corporation, New Haven, Conn.

[21] Appl. No.: 139,617

[22] Filed: Apr. 11, 1980

[51] Int. Cl.[3] ..... B22D 27/02

[52] U.S. Cl. ..... 164/503

[58] Field of Search ..... 164/48, 49, 146, 147, 164/250, 251, 467, 498, 503

[56] References Cited

U.S. PATENT DOCUMENTS

| | | | |
|---|---|---|---|
| 2,686,864 | 8/1954 | Wroughton et al. | 164/49 X |
| 3,075,264 | 1/1963 | Wognum . | |
| 3,476,170 | 11/1969 | Christian et al. | 164/48 |
| 3,936,346 | 2/1976 | Lloyd . | |
| 4,161,206 | 7/1979 | Yarwood et al. | 164/49 |

FOREIGN PATENT DOCUMENTS

| | | |
|---|---|---|
| 1481301 | 7/1977 | United Kingdom . |
| 1499809 | 1/1978 | United Kingdom . |

*Primary Examiner*—Gus T. Hampilos
*Assistant Examiner*—K. Y. Lin
*Attorney, Agent, or Firm*—Paul Weinstein

[57] ABSTRACT

A process and apparatus for casting a material into a desired thin strip shape. Molten material is formed into the thin strip shape by an electromagnetic containing and forming process. In a first portion the molten material is shaped into the desired thin strip shape and in a second portion upstream of and communicating with the first portion the molten material is electromagnetically contained in a sump. The sump at a top surface thereof has a substantially larger cross-sectional area as compared to a cross-sectional area of the thin strip shape.

14 Claims, 3 Drawing Figures

ELECTROMAGNETIC THIN STRIP CASTING APPARATUS

CROSS REFERENCE TO RELATED APPLICATION

U.S. Patent Application Ser. No. 9,429, by Gaule et al. for "Multi-Turn Coils Of Controlled Pitch For Electromagnetic Casting".

BACKGROUND OF THE INVENTION

This invention relates to an improved process and apparatus for electromagnetically casting materials including metals, alloys and metalloids such as silicon. The process and apparatus of this invention can be adapted for forming polycrystalline or single crystal thin strip castings.

PRIOR ART STATEMENT

The electromagnetic casting process has been known and used for many years for continuously and semi-continuously casting metals and alloys. The process has been employed commercially for casting aluminum and aluminum alloys. The process in its known application has been used for casting relatively thick castings.

The electromagnetic casting apparatus comprises a three part mold consisting of a water cooled inductor, a non-magnetic screen and a manifold for applying cooling water to the casting. Such an apparatus is exemplified in U.S. Pat. No. 3,467,166 to Getselev et al. Containment of the molten metal is achieved without direct contact between the molten metal and any component of the mold. Solidification of the molten metal is achieved by the direct application of water from a cooling manifold to the solidifying shell of the casting.

An elaborate discussion of the prior art relating to electromagnetic casting is found in U.S. Pat. No. 4,161,206 to Yarwood et al. That prior art statement is intended to be incorporated by reference herein. The Yarwood et al. patent itself deals with a control system for controlling the electromagnetic process.

U.S. Pat. Nos. 3,985,179 and 4,004,631 to Goodrich et al. show the use of shaped inductors in electromagnetic casting.

In electromagnetic casting the molten metal sump above the solidification zone is normally shaped into the same cross section as the desired solidified casting. Therefore, if the process is applied to the casting of thin strip sections, a small volume molten metal sump results. Small variations in the molten metal temperature delivered to a small volume molten metal sump as well as small differences in cooling rate during the casting process itself will all tend to make large temperature variations in the small volume molten metal sump and these temperature variations can lead to premature freezing and abortion of the casting run.

Other problems, however, are also present when one contemplates electromagnetic containment in place of a conventional direct chill casting mold. In electromagnetic casting it is necessary to precisely control the flow of molten metal downwards into the containment zone or molten metal sump because the size of the molten metal head affects the hydrostatic pressure in the containment zone exerted by the molten metal and, therefore, the force necessary to provide containment.

Adapting electromagnetic casting to the casting of thin strip sections would present added difficulties particularly when the section thickness is less than about ¼". The problem is even more difficult when section thicknesses of less than 0.100" such as 0.025" are required for casting material such as silicon for use in semi-conductor applications. In this latter instance it is extremely difficult to maintain shape control by the electromagnetic process particularly at the lateral edges of the strip.

U.S. Pat. No. 3,463,365 to Dumont-Fillon and British Pat. No. 1,481,301 are exemplary of the art relating to the use of electromagnetic fields for controlling metal flow from a tundish or crucible into a mold. In the British patent an electromagnetic field is not only used to control the flow of molten metal from the crucible but also to keep the molten metal from flowing against the refractory of a portion of the crucible to thereby reduce erosion of the refractory. In the British 1,481,301 patent the crucible is relatively large in diameter as compared to the opening or nozzle through which the molten metal exits the crucible and is supplied to the mold.

In British Pat. No. 1,499,809 a rod casting system is provided utilizing a crucible and electromagnetic flow control arrangement similar to that described in the previous 1,481,301 British patent. However, in this case the electromagnetic coil which controls metal flow also serves to shape the metal into the desired rod shape which is then cooled with water to solidify it and rolled into a final desired rod or wire product.

The arrangements disclosed in the British patents since they are a hybrid using both a crucible and electromagnetic forces for containment suffer drawbacks in that the molten metal sump which is supported by the crucible is subject to contamination by the crucible. Further, in the arrangement of the British 1,499,809 patent water from the cooling station could be splashed up between the molten metal and the crucible in the narrow neck portion and, thereby, subject the apparatus to potential explosive situations. In order to overcome these problems in accordance with this invention an arrangement is provided whereby a large molten material pool or sump is supported above the narrow strip forming section of the electromagnetic mold wherein solidification takes place, solely by means of electromagnetic containment forces.

This arrangement is to be contrasted with ordinary levitation melting apparatuses such as those described in U.S. Pat. Nos. 2,686,864 to Wroughton et al. and 3,476,170 to Christian et al. In those apparatuses an inductor is utilized to levitate a melt and in Wroughton et al. to even controllably drain from the melt. However, none of these apparatuses employ an electromagnetic containment arrangement wherein the molten metal sump is contained which is relatively larger in thickness than the desired thickness of the thin strip product being cast.

SUMMARY OF THE INVENTION

In accordance with this invention a thin strip casting apparatus and process are provided. The process and apparatus are adapted for casting in thin strip form a wide variety of molten materials including metals, alloys and various materials adapted for use in electronic components such as silicon. In accordance with one aspect of the invention an electromagnetic forming and containing means is provided which at the solidification zone is adapted to shape the material in molten form into the desired thin strip cross section and at a second zone is adapted to support an enlarged sump of molten material. The enlarged sump of molten material reduces variations in temperature of the molten material delivered to the solidification zone and reduces variations in hydrostatic pressure exerted by the molten material in the solidification zone. Containment of the molten material in both the enlarged supply sump and the solidification zone is solely by means of electromagnetic forces acting upon the material. This is accomplished in accordance with a preferred embodiment by shaping an electromagnetic inductor so that in a first portion it has a cross section corresponding to the cross section of the desired thin strip casting, while in a second portion it has an enlarged cross section wherein it is flared out from the first portion. Preferably the open end defined by the upper surface of the inductor is at least five times larger in cross-sectional area as compared to the opening in the inductor at the solidification zone. The apparatus may optionally include a non-magnetic screen in order to control the curvature of the molten material at the top surface of the molten metal sump.

In accordance with another aspect of this invention castings have ultra thin strip cross sections are formed wherein the thickness of the strip is less than about 0.250" and preferably less than about 0.100". A means is provided for applying an alternating current to the inductor whose frequency is selected such that the penetration depth of the current in the molten metal at the casting zone is less than about ¼ and preferably less than about 1/6 of the thickness of the strip being cast. In this manner it should be possible to cast extremely thin strips of materials such as silicon or other desired materials while maintaining adequate shape control and without contamination of the material being cast.

In a further embodiment the shaped inductor used for containment is also used to heat and melt the material to be cast.

Accordingly, it is an object of this invention to provide an improved apparatus and process for thin strip casting of metals, alloys, metalloids such as silicon and other desired materials.

It is a further object of this invention to provide an apparatus and process as above which is adapted to provide reduced contamination of the molten material being cast.

It is a still further object of this invention to provide an apparatus and process as above which is adapted to provide excellent control of the shape of ultra thin strip over its whole cross section.

These and other objects will become more apparent from the following description and drawings.

DETAILED DESCRIPTION OF PREFERRED EMBODIMENTS

Figure 1:
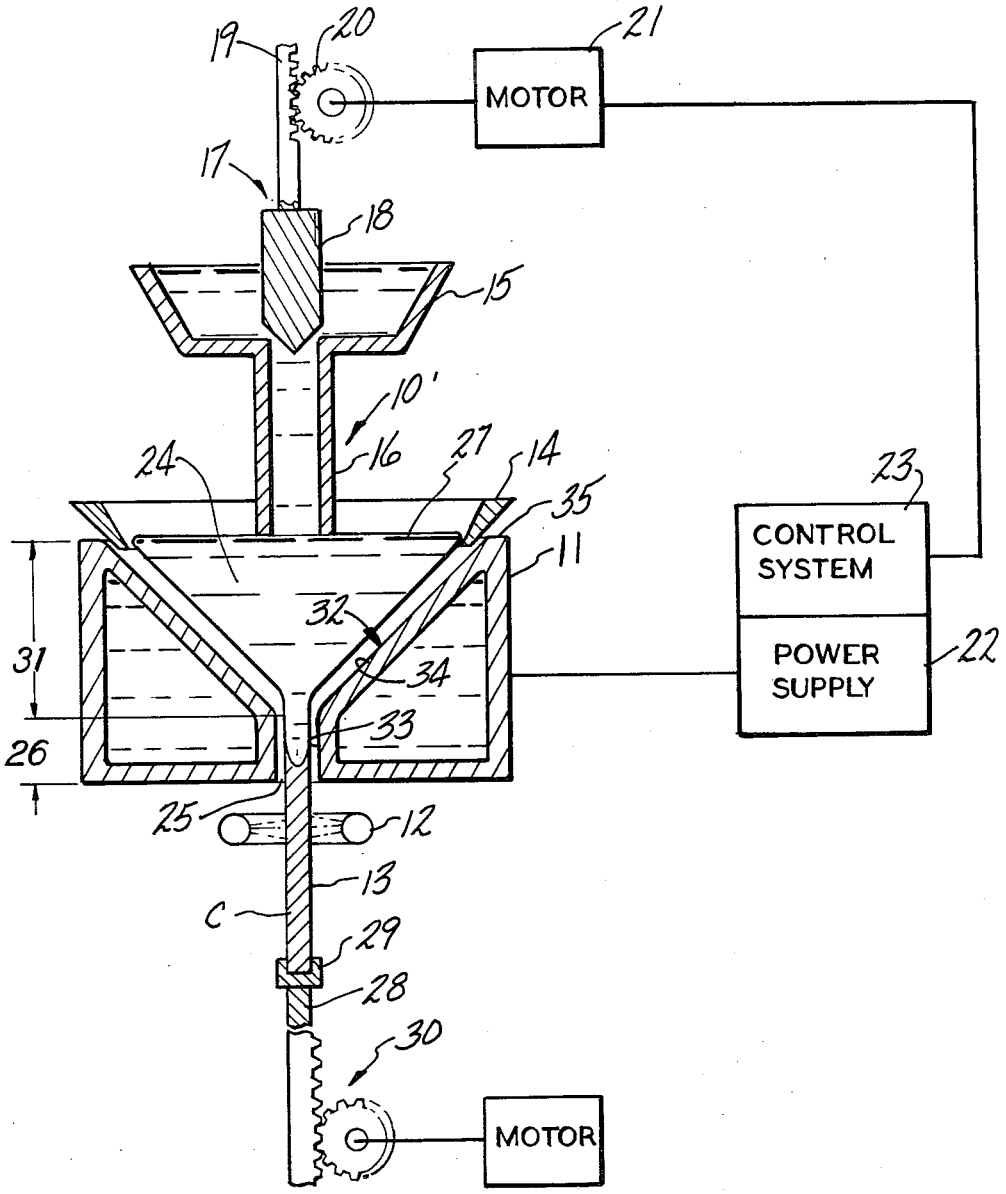
FIG. 1 is a schematic representation of a casting apparatus in accordance with one embodiment of this invention.

Referring now to FIG. 1 there is shown by way of example an electromagnetic casting apparatus of this invention. The electromagnetic casting mold 10 is comprised of an inductor 11 which is water cooled; a cooling manifold 12 for applying water to the peripheral surface 13 of the material being cast C and a non-magnetic screen 14. In accordance with this embodiment molten material such as a metal is continuously introduced into the mold during a casting run in a normal manner using a trough 15, downspout 16 and molten metal head control 17. The head control 17 can comprise an ordinary valve member 18 which can be manually operated or preferably automatically controlled in the manner described in U.S. Patent Application Ser. No. 110,893, filed Jan. 10, 1980, by Ungarean et al. In accordance with the preferred approach the valve member 18 is arranged for movement axially of the casting C and downspout 16 by means of rack 19 and pinion 20 arrangement actuated by a suitable stepping or serving motor 21 which in turn is actuated from the power supply 22 and control system 23. The flow of molten metal through the downspout 16 is controlled in accordance with long term increases or decreases in the inductance of the inductor 11. Further details of this approach can be found by reference to the Ungarean et al. application.

The inductor 11 is excited by an alternating current from a power source 22 and control system 23. The power source 22 and control system 23 may be of any desired design, however, preferably it is in accordance with the teachings of U.S. Pat. No. 4,161,206 to Yarwood et al. In that approach the current in the inductor 11 is controlled in a manner so as to maintain the inductance of the inductor 11 substantially constant. This insures a uniform air gap being maintained between the molten metal and the opposing inductor 11 as a casting run proceeds.

The alternating current in the inductor 11 produces a magnetic field which interacts with the molten metal head 24 to produce eddy currents therein. These eddy currents in turn interact with the magnetic field and produce forces which apply a magnetic pressure to the molten metal head 24 to contain it so that it solidifies in a desired ingot cross section. An air gap 25 exists during casting between the molten metal head 24 and the inductor 11. The molten metal head 24 is formed or molded in the solidification zone 26 into the same general shape as the inductor 11 thereby providing the desired casting cross section. The inductor 11 preferably has a rectangular shape surrounding the molten metal in order to obtain the desired thin strip cross section.

The purpose of the non-magnetic screen 14 is to fine tune and balance the magnetic pressure with the hydrostatic pressure of the molten metal head 24 near the upper surface 27 of the molten metal head 24. The non-magnetic screen 14 may comprise a separate element as shown or may be integrated into other structural elements of the apparatus such as the inductor as in the patents to Goodrich et al.

Initially, a conventional ram 28 and bottom block 29 is held in the solidification zone 26 of the mold 10 to allow the molten metal to be poured into the mold at the start of a casting run. The ram 28 and bottom block 29 are then uniformly withdrawn at a desired casting rate by means of a withdrawal mechanism 30 which may be of conventional design.

Solidification of the molten metal which is magnetically contained in the mold 10 is achieved by direct application of water from the cooling manifold 12 to the solidifying casting C surface 13. In the embodiment which is shown in FIG. 1 water is applied to the casting surface 13 just below the inductor and in very close proximity therewith. Alternatively, if desired, the water may be applied to the casting surface 13 within the inductor by providing suitable water cooling ejection slots or ports in the inductor 11 itself.

The apparatus shown in FIG. 1 departs from those apparatuses known in the art of electromagnetic casting specifically in that the molten metal sump 24 has a non-uniform cross section. In a first portion 26 of the containment zone wherein solidification takes place the molten metal is formed into the desired cross-sectional shape for the resulting thin strip casting. At a second portion 31 of the containment zone upstream of the first portion, the molten metal sump 24 flares out so as to create at its upper surface 27 a cross-sectional area which is preferably at least about five times greater than the cross-sectional area of the strip C being cast and most preferably at least seven times greater.

The second portion 31 of the containment zone creates a molten metal sump which is substantially wider than the strip C being cast. The volume of the molten metal sump 24 is sufficiently great to insure that temperature differentials within the molten metal sump are minimized and to further insure that the molten metal head height which controls the hydrostatic pressure of the molten metal within the solidification portion 26 of the containment zone is maintained substantially constant. This reduces fluctuations in the hydrostatic pressure and provides a resultant strip C product of higher cross-sectional and thickness uniformity.

In the preferred embodiment shown in FIG. 1 the electromagnetic containment zone providing the two portions as described above is achieved by means of a unique inductor 11 design. The surface 32 of the inductor facing the molten metal is divided into two corresponding portions 33 and 34. The first portion 33 has a general shape corresponding to the desired shape of the thin strip casting C. The second portion 34 is flared outwardly from the first portion to provide at the top 35 of the inductor 11 an air space defining the containment zone having a first cross-sectional area which is substantially greater than the second cross-sectional area of the air space defining the containment zone of the first portion. Preferably, the first cross-sectional area is greater than about five times as large as the second cross-sectional area and most preferably at least seven times greater.

It should be apparent that the current in the inductor 11 will concentrate at the first portion 33 because it represents the shortest path. However, at a suitable power level sufficient current should flow in the second portion 34 to support the molten metal sump 24. This is a highly desired characteristic of the inductor 11 as shown because in the first portion 33 the highest hydrostatic forces are provided by the molten metal since the molten metal head height at that portion is the greatest. Therefore, it is desired that the current density or current per unit area of surface 33 at that portion also be the greatest. As one proceeds along the flared portion 34 of the inductor 11, the current density will gradually decrease as the current path increases. This is desirable because the molten metal head height which is supported at each succeeding point outwardly along the flared portion 34 decreases correspondingly. The angle of inclination of the surface 34 is preferably selected so that for the material being cast there is a general balance between the current magnitude in the inductor and the hydrostatic pressure exerted by the molten material at each point in the portion 31 of the containment zone. For example, the molten metal head height and, therefore, the hydrostatic pressure exerted by the molten metal at each point of the portion 34 of the inductor 11 can generally be increased by making the surface 34 more vertically oriented and vice versa.

In the embodiment which is shown a non-magnetic screen 14 or shield has been employed to intercept a portion of the field from the inductor 11 near the top surface 27 to prevent undue rounding off of the top corners of the molten metal sump 24. In practice, however, it may be possible due to the particular shape of this inductor 11 to eliminate the need for the shield 14 which, therefore, is not believed to be an essential element in this apparatus. This is the case since the current density at the top 35 of the inductor 11 will be at its lowest due to the large current path.

The process and apparatus described by reference to FIG. 1 is particularly adapted for the casting of thin strips from metals and alloys. In such an instance the cooling medium provided by the coolant manifold 12 would be water or other suitable medium as desired. The casting apparatus shown in FIG. 1 is adapted for forming thin strip castings up to about $\frac{3}{4}''$ thick and preferably up to about $\frac{1}{2}''$ thick. Such thin strip castings C are particularly adapted for use in forming by cold rolling strip type materials which can have any desired gage down to a few thousandths of an inch. An advantage of casting the metals or alloys in strip form is that the normal breakdown hot rolling which is utilized conventionally to roll the conventional multi inch thick ingots to a cold rollable gage can be eliminated.

Figure 2:
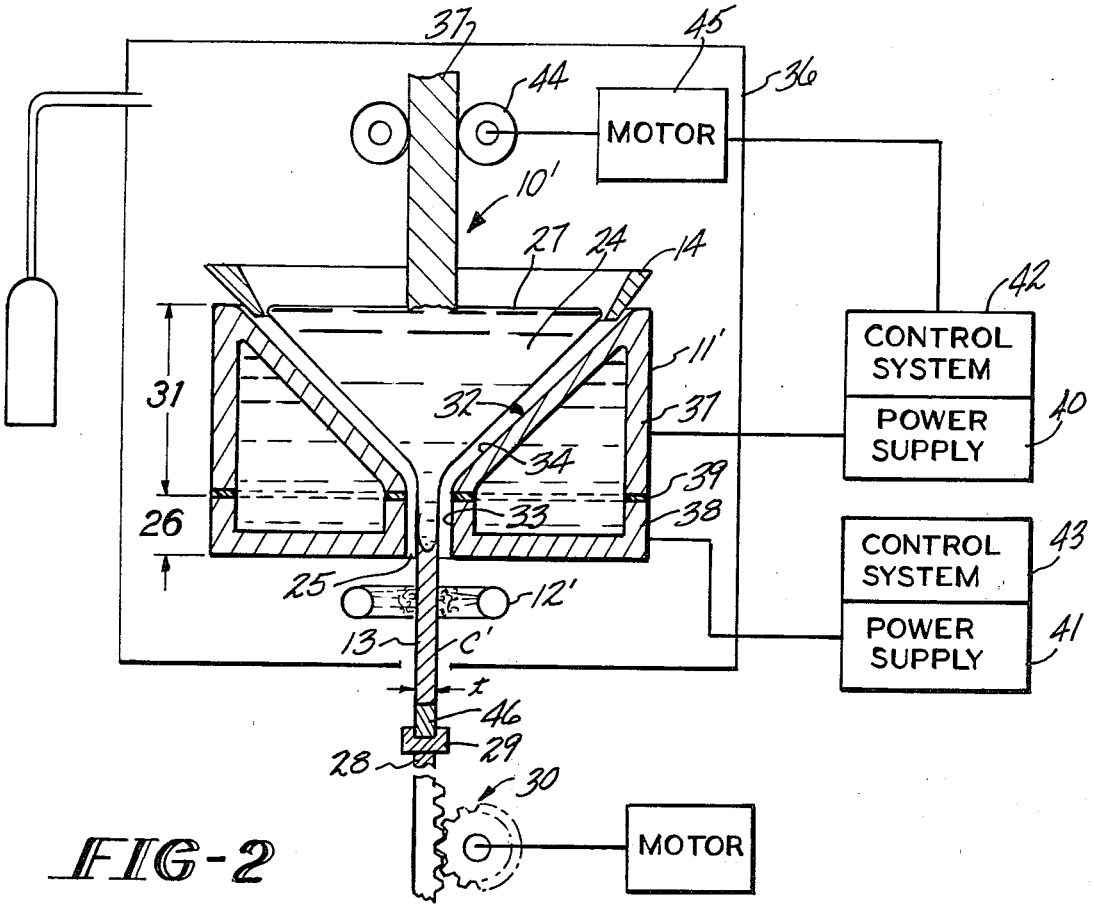
FIG. 2 is a schematic representation of a casting apparatus in accordance with a different embodiment of the present invention.

The apparatus as aforenoted can have further application in the casting of ultra thin strip from materials such as metals, alloys and metalloids including semi-conductor materials such as silicon, germanium, etc. A particularly preferred apparatus for ultra thin strip casting C′ is shown in FIG. 2. The apparatus shown in FIG. 2 is adapted to provide ultra thin strip castings C′ which are optionally of a single crystal nature. In this embodiment the entire mold 10′ is supported within a chamber 36 which provides an inert gas atmosphere such as argon so as to maintain the purity of the material being cast. Rather than a trough 15 and downspout 16 arrangement as in FIG. 1 for transporting the molten material from a remote melting source, the silicon 37 or other material is added fom a solid bar. The inductor 11′ and shield 14 arrangement are similar to those elements as described in reference to the previous embodiment. The inductor 11′, however, while having the same general shape as the inductor 11 in FIG. 1 has a significantly different structure. Namely, the inductor 11′ has been divided into two sections 37 and 38. The upper section 37 includes the surface 34. The lower section of the inductor 38 includes the surface 33. An insulating gasket 39 is employed between the upper and lower sections 37 and 38. The insulating gasket 39 serves to electrically insulate the upper section 37 from the lower section 38. The two sections 37 and 38 are secured together in a water tight manner by means of insulating screws (not shown). The purpose of insulating the upper section 37 from the lower section 38 is to provide independent powering of the upper section relatively to the lower section in order to tailor the current levels in the respective surfaces 33 and 34 of the inductor 11′. This will aid in providing the desired strip forming action in the portion 26 of the inductor 11' and the desired molten material sump supporting action in the portion 31.

In order to tailor the power applied to each section 37 and 38 of the inductor 11' it is necessary to employ two power supplies 40 and 41 and two control systems 42 and 43, respectively. In this manner the current applied to the upper section 37 of the inductor 11' may be totally different than the current applied to the lower section 38 resulting in corresponding differences in the magnetic field strengths of the respective sections 37 and 38. Depending on the material being cast it should be possible to better balance the desired magnetic force provided by the inductor 11' and the hydrostatic pressures exerted by the material being cast.

In the embodiment shown in FIG. 2 the system is set up preferably for casting semi-conductor materials such as silicon as a single crystals. In this instance the silicon is required to have a very high purity and retain that high purity in the final cast product. Therefore, the casting is carried out in an inert atmosphere as above described. It is further desired that the material being cast not contact any other material such as a crucible in order to avoid contamination.

Referring still to FIG. 2 it is apparent that the inductor 11' is otherwise shaped and functions in substantially the same manner as the inductor 11 in FIG. 1, The similarly referenced surfaces 33 and 34 function in the same manner to provide a solidification zone 26 and a molten material sump 31 as in the previous embodiment. The power supplies 40 and 41 and control systems 42 and 43 operate in the same manner as the previously described power supply 22 and control system 23 except that the respective current levels in the upper section 37 and lower section 38 of the inductor 11' may be varied as described above. As in the previous embodiment, the screen 14 represents an optional element since it may be possible to avoid its use depending on the magnetic field exerted by the shaped inductor 11'. While the apparatus of FIG. 2 is particularly adapted for forming ultra thin strip having a single crystal morphology it can be utilized for casting other materials and thicknesses just as in accordance with the previous embodiment.

In the embodiment of FIG. 2 the molten material sump 24 is replenished by melting the end of a solid bar 37 of the material being cast. To accomplish this melting it is proposed in accordance with a preferred aspect of this invention that the inductor 11' be powered in a manner so as to not only contain and support the molten material sump 24 but so as to also heat the material in the sump 24 to a temperature at which it will melt the solid addition bar 37 as it is advanced into the sump 24. This is accomplished by balancing the pressure and heat input provided by the upper section 37 of the inductor 11'. In order to provide melting the frequency of the applied current is increased. This serves to increase the heating effect of the applied field and the effective resistance of the melt. Obviously, the ability to use the inductor 11' for both heating and containment will be to a large degree affected by the resistivity of the material being cast. In the case of semi-conductive type materials such as silicon or germanium their high resistivity will serve to improve the heating effect of the inductor. It may not be possible to use the inductor for both containment and heating when comparatively low resistivity materials are employed. However, generally speaking it is usually desired to form ultra thin strip castings from such high resistivity materials which find application in semi-conductor and electronic devices.

As in the previous embodiment, the movement of the solid addition bar 37 of silicon into the molten metal sump 24 is controlled by the control system 42 of the inductor 11' so that the upper surface 27 of the molten material is maintained at a substantially constant position in order to reduce changes in the hydrostatic pressure exerted by the molten material in the solidification zone 26. This may be accomplished by utilizing feed rollers 44 connected to a motor 45 which in turn is powered from the control system 42. In this embodiment as in the previous embodiment the control system controls the replenishment of the molten material sump 24 by preferably maintaining a constant inductance on the inductor 11'. If the height of the molten metal 27 increases or decreases, there is a change in the hydrostatic pressure applied by the molten material. This in turn will cause the molten metal sump to either reduce the air gap 25 between it and the inductor or increase it, respectively. In either case the inductance of the inductor will be correspondingly changed. In accordance with the Yarwood et al. patent as described in the background of this application the inductance may be kept constant by means of the power applied to the inductor and in accordance with the Ungarean et al. application described in this application the inductance of the inductor can also be maintained within a desired limit by means of controlling the replenishment of the sump. Both of these approaches are preferably applied in accordance with the present invention in order to control the casting system to provide a resultant thin strip casting C or C' of uniform cross section.

The action of the molten material and the power applied by the inductor 11' is sufficient to slowly melt the bar 37 of silicon as a replenishment for the silicon material withdrawn from the casting zone 36 as a solidified ultra thin strip C'. While it is preferred in accordance with this embodiment that the inductor provide the energy for both supporting the molten material sump 24 and for melting the replenishment material 37 it is possible in accordance with this invention to melt the replenishment material at a remote location as described by reference to FIG. 1. In such an instance it would not be necessary for the inductor 11 or 11' to serve the dual purposes of heating for melting the replenishment material and for containment.

In casting silicon or other desired material in thin strip single crystal form it is necessary that the casting rate or drop rate of the ram 28 be very slow in accordance with known single crystal growing techniques. Therefore, the drop rate of the solid silicon material 37 being melted would be correspondingly slow. Further, to avoid contamination and in view of the slow withdrawal rates, instead of cooling the silicon strip C' by means of the application of water an inert gas preferably could be applied from manifold 25'. The single crystal morphology is obtained by using a single crystal seed 46 supported by the bottom block 29 of the casting apparatus.

It is an important aspect when casting ultra thin strips C' that the power supply provide a current to the inductor 11' which is at a frequency which is selected such that the penetration depth of the current induced in the molten material is less than about $\frac{1}{4}$ of the thickness t of the strip being cast and preferably less than 1/6 thereof. The penetration depth is given by the following formula:

$$\delta = \sqrt{\frac{\int}{\mu_o \pi f}}$$

In the above formula $\delta$=the penetration depth. $\delta$ comprises the depth in the material in question at which the current is reduced by about 67% as compared to the current at the outer peripheral surface 13. $\rho$=the resistivity of the material being cast. $\mu_o$=the permeability of the material being cast. f=the frequency of the applied current. $\pi$=3.14.

Penetration depth "$\delta$" in accordance with the present invention is defined by the above formula. In accordance with that formula it will be apparent that as the frequency of the applied current is increased the penetration depth decreases. In ordinary casting utilizing electromagnetic practices it has been conventional to employ a penetration depth of 5 millimeters. In the Yarwood et al. 4,161,206 patent mentioned in the background of this invention the influence of resistivity on penetration depth has been amply demonstrated. In accordance with this invention in order to maintain adequate shape control, by which is meant a uniform shape or cross section over the length of the casting the penetration depth must be very carefully controlled by controlling the frequency of the applied current. Preferably, the penetration depth should be less than about ¼ of the thickness of the strip being cast and most preferably less than about 1/6 of the thickness of the strip being cast. These preferred limits should insure that there is little or no interaction between the field applied at one side of the strip C' as compared to the field applied at the other side of the strip. It is believed that avoiding such interactions will minimize the difficulties in obtaining a strip C of uniform thickness and cross section. It is further believed that if these limits are not maintained then the resulting strip C' could have an undesirable oval cross section.

If it were desired to carry out the casting process without the formation of a single crystal structure, then the seed crystal would be eliminated and the bottom block initially positioned within the containment field as described by reference to FIG. 1. For the casting of single crystal structures, however, the seed crystal is positioned initially in the containment field and then slowly withdrawn at a rate consistent with obtaining the desired single crystal morphology. If a non-single crystal structure is acceptable, then it is possible to employ water cooling in place of the gas cooling, if desired. However, gas cooling is preferred when casting a single crystal structure.

Figure 3:
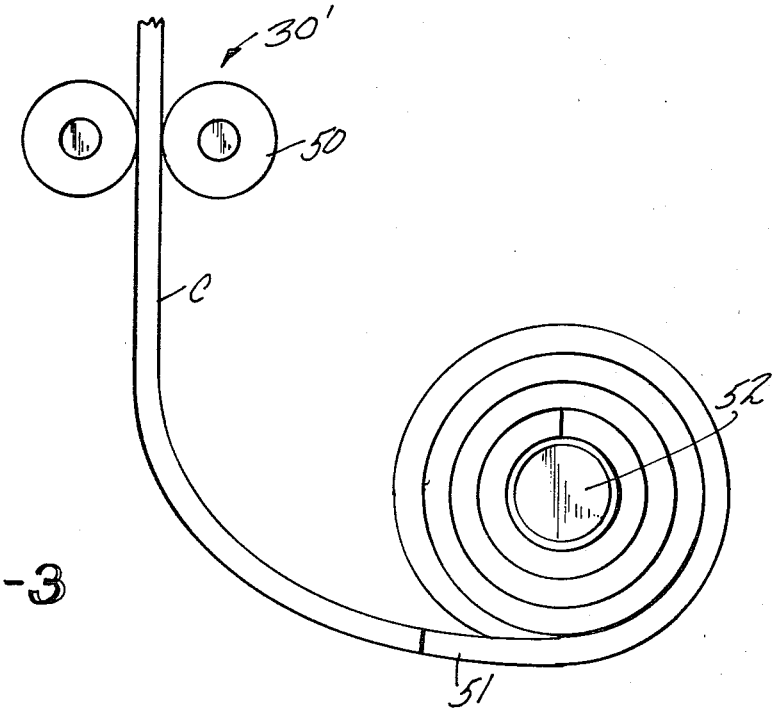
FIG. 3 is a partial schematic representation of an alternative casting withdrawal mechanism in accordance with this invention.

Referring now to FIG. 3, an alternative withdrawal mechanism 30' is shown. The withdrawal mechanism 30 employed in the embodiments of FIGS. 1 and 2 are more than adequate for continuously or semi-continuously forming the thin strip casting of a reasonable length depending on the available movement of the ram 28 and bottom block 29. If longer thin strip castings are desired, then a withdrawal mechanism 30' as in FIG. 3 can be employed. In this embodiment initially a thin strip starter block 51 is positioned between feed rolls 50 so that the end of the starter block strip is located within the containment zone 26 as in the previous embodiments. The feed rolls 50 control the rate at which the starter block strip 51 and the casting C are withdrawn from the containment zone 26. After the strip leaves the feed rolls 50 it is coiled up upon a drum 52. In this manner it is possible to cast extremely long lengths of the strip type material C.

While the invention has been described generally by reference to metals and alloys, it is particularly adapted for use with copper and copper alloys, steel and steel alloys, aluminum and aluminum alloys, and nickel and nickel alloys, although other metals and alloys are not intended to be excluded. While the invention has been described with respect to the casting of metalloids, such as silicon or germanium, it is applicable to a wide range of such semimetals which find application in semi-conductor devices including sapphire and compound semiconductive materials, such as gallium-arsenide or the like. These materials are mentioned only by way of example and it is not intended to exclude other metalloids or semi-metal type materials finding application in electronic devices.

The patents set forth in this application are intended to be incorporated by reference herein.

It is apparent that there has been provided in accordance with this invention an electromagnetic thin strip casting apparatus and process which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In an apparatus for casting a material into a desired thin strip shape, said apparatus comprising:

means for electromagnetically containing and forming said material in molten form into a desired shape; the improvement wherein:

said electromagnetic forming and containing means comprises:

at least one single turn inductor having a first portion for shaping said molten material into said desired thin strip shape and a second portion upstream of and communicating with said first portion for containing solely by an electromagnetic field a sump of said molten material, said second portion of said inductor defining a containment zone air space at a top surface thereof having a cross-sectional area at least five times greater than a cross-sectional area of a containment zone air space defined by said first portion of said inductor;

whereby the cross-sectional area at a top surface of said sump of molten material is substantially greater than the cross-sectional area of said desired thin strip shape.

2. An apparatus as in claim 1 wherein said electromagnetic containing and forming means comprises at least two electrically isolated single turn inductor portions and wherein a first of said inductor portions is shaped to form said thin strip shape and a second of said inductor portions is shaped to contain said sump of molten material; and means for independently powering each of said inductor portions.

3. An apparatus as in claim 1 wherein said electromagnetic containing and forming means further includes means for applying an alternating current to said at least one single turn inductor to generate a magnetic field; and wherein means are provided for controlling the frequency of said current applying means so that the penetration depth of the current induced in said molten material by said first portion of said inductor is not greater than one quarter of the thickness of said desired thin strip shape.

4. An apparatus as in claim 3 wherein said desired thin strip shape has a thickness of up to about 0.25" and wherein said means for controlling said frequency is adapted to provide a penetration depth of said current induced in said molten material of not greater than one sixth the thickness of said desired thin strip shape.

5. An apparatus as in claim 1 wherein said electromagnetic containing and forming means includes means for applying an alternating current to said inductor to generate a magnetic field; and wherein means are provided for heating said molten material to a desired temperature, said means for heating said molten material comprising said at least one inductor and alternating current applying means.

6. An apparatus as in claim 1 further including means for replenishing said molten material sump, said replenishing means including means for adding said material in solid form to said molten material sump.

7. An apparatus as in claim 6 wherein said means for adding said material in solid form comprises means for advancing a solid member of said material into said molten material sump at a desired rate.

8. An apparatus as in claim 7 wherein said means for advancing said member comprises roll means and means for driving said roll means to advance said member at said desired rate.

9. An apparatus as in claim 8 wherein control means are provided for controlling the rate at which said member is advanced into said molten material sump.

10. An apparatus as in claim 9 wherein said control means is responsive to an inductance of said at least one inductor.

11. An apparatus as in claim 1 wherein said means for electromagnetically containing and forming said material in molten form into said desired shape further includes means for applying an alternating current to said at least one inductor and wherein means are provided for controlling the current in said at least one inductor in a manner so as to maintain the inductance of said at least one inductor substantially constant.

12. An apparatus as in claim 1 wherein said inductor in said first portion includes a first surface opposed to said material being cast having a shape corresponding to said desired thin strip casting and in said second portion includes a second surface flared outwardly from said first surface in opposition to said sump of molten material.

13. An apparatus as in claim 7 further including single crystal seed means for forming a single crystal thin strip casting.

14. An apparatus as in claim 1 further including means for coiling up said thin strip material, whereby very long lengths of said thin strip casting can be obtained.

* * * * *

UNITED STATES PATENT AND TRADEMARK OFFICE

CERTIFICATE OF CORRECTION

PATENT NO. : 4,353,408

DATED : October 12, 1982

INVENTOR(S) : Michael J. Pryor

It is certified that error appears in the above—identified patent and that said Letters Patent is hereby corrected as shown below:

In Column 3, line 23, the word "have" should read ---having---.

In Column 7, line 17, the word "crystals" should read ---crystal---.

In the formula at the head of Column 9, lines 1 to 5, in the numerator of the fraction change the integral sign "∫" to a rho sign ---ρ---;

In Column 9, line 54, the word "mechanism" should read ---mechanisms---.

In Column 12, line 24, "claim 7" should read ---claim 1---.

Signed and Sealed this

Twenty-eighth Day of December 1982

[SEAL]

*Attest:*

GERALD J. MOSSINGHOFF

*Attesting Officer*

*Commissioner of Patents and Trademarks*